US006857861B2

(12) United States Patent
Condon et al.

(10) Patent No.: US 6,857,861 B2
(45) Date of Patent: Feb. 22, 2005

(54) RING FOR CONCRETE PUMP

(75) Inventors: Gary J. Condon, Irwin, PA (US); Mark T. Klingensmith, Apollo, PA (US); James Cavanaugh, Greensburg, PA (US)

(73) Assignee: Kennametal Inc., Latrobe, PA (US)

( * ) Notice: Subject to any disclaimer, the term of this patent is extended or adjusted under 35 U.S.C. 154(b) by 0 days.

(21) Appl. No.: 10/146,508

(22) Filed: May 15, 2002

(65) Prior Publication Data

US 2003/0215344 A1 Nov. 20, 2003

(51) Int. Cl.[7] ..... F04B 7/00

(52) U.S. Cl. ..... 417/517; 417/519; 417/900; 137/625.11

(58) Field of Search ..... 417/517–519, 417/900; 137/625.11

(56) References Cited

U.S. PATENT DOCUMENTS

| | | | | | |
|---|---|---|---|---|---|
| 3,726,614 | A | * | 4/1973 | Schellenberg | 417/517 |
| 4,057,373 | A | | 11/1977 | Schwing | 417/519 |
| 4,178,142 | A | | 12/1979 | Schwing | 417/516 |
| 4,465,441 | A | | 8/1984 | Schwing | 417/517 |
| 4,486,156 | A | * | 12/1984 | Feger et al. | 417/517 |
| 4,653,990 | A | | 3/1987 | Schlecht | |
| 4,664,595 | A | * | 5/1987 | Tsuji et al. | 415/229 |
| 5,037,275 | A | * | 8/1991 | Schlecht | 417/517 |
| 5,106,272 | A | | 4/1992 | Oakley et al. | 417/347 |
| 5,118,647 | A | | 6/1992 | Newkirk et al. | |
| 5,281,113 | A | | 1/1994 | Simnovec | 417/519 |
| 5,302,094 | A | | 4/1994 | Schlecht et al. | 417/517 |
| 5,332,366 | A | | 7/1994 | Anderson | 417/63 |
| 5,380,174 | A | | 1/1995 | Schwing | 417/519 |
| 5,857,490 | A | * | 1/1999 | Kao | 137/625.45 |
| 6,206,662 | B1 | * | 3/2001 | Schwing | 417/517 |
| 6,305,916 | B1 | * | 10/2001 | Reinert | 417/454 |
| 6,327,946 | B1 | | 12/2001 | Felter et al. | |
| 6,338,615 | B1 | * | 1/2002 | Hurr et al. | 417/517 |
| 2002/0030085 | A1 | * | 3/2002 | Sollami | 228/132 |

FOREIGN PATENT DOCUMENTS

| | | |
|---|---|---|
| EP | 0237376 A1 | 9/1987 |
| GB | 2078313 A | 1/1982 |
| WO | WO 93/19214 | 9/1993 |
| WO | WO 01/25505 A1 | 4/2001 |

OTHER PUBLICATIONS

"Exposition Directory & Events Schedule" from Construction, Construction Materials and Power Transmission Industries Conexpo, Mar. 19–23, 2002, Las Vegas, NV, USA, Title Page, p. 277 and 2 pages color photos).

International Search Report mailed Sep. 17, 2003 in corresponding PCT Appl. #PCT/US03/14362.

* cited by examiner

*Primary Examiner*—Charles G. Freay
(74) *Attorney, Agent, or Firm*—Matthew W. Smith

(57) ABSTRACT

A pivot pipe for a two-cylinder thick material sludge pump is designed to reduce the rate of wear of the sealing surfaces and flow bores of the pivot pipe and cooperating outlets on the two pump cylinders. As the pivot pipe oscillates from one pump cylinder to the other pump cylinder the contacting sealing surfaces are subjected to abrasion and impact wear. The present invention limits the rate of wear between the contacting sealing surfaces and a portion of the flow bore by fixing monolithic wearing rings on the upstream end of the pivot pipe and on the outlets of the two pump cylinders. The monolithic wearing rings are made of a hard materials such as cemented tungsten carbide.

18 Claims, 5 Drawing Sheets

RING FOR CONCRETE PUMP

BACKGROUND OF THE INVENTION

There are many types of pumping machines which are known in the art. These pumps vary in function from those which are used to pump fluids such as gaseous materials, through pumps for liquids, to those types of pumps which are used to pump highly viscous, particulate material. The known pumps can be used to pump other materials such as slurries, granular material, thick material sludge or the like. One particular type of pump apparatus which is well known in the art is used to pump concrete from a mixer apparatus to a remote location of utilization. These pumps are frequently hydraulically powered so as to provide a sufficient force to move the relatively heavy concrete.

Positive displacement pumps are frequently used for conveying concrete and other materials through pipelines in construction applications. An example of a positive displacement pump of this type is shown in Oakley et al., U.S. Pat. No. 5,106,272, entitled SLUDGE FLOW MEASURING SYSTEM. Positive displacement pumps offer a number of significant advantages over screw or belt conveyors in the pumping of materials such as concrete. For example, positive displacement pumps are capable of pumping thick, heavy materials which may not be practical for screw conveyors. Pump and pipeline systems also take up less space than screw or belt conveyors and, with the use of simple elbow pipes, are capable of transporting concrete around corners. Additionally, positive displacement pumps offer a reduction in noise over mechanical conveyors, as well as greater cleanliness and reduced spillage.

Many of the existing pumps use a ball valve to control the flow of concrete from the input source to the delivery line. However, in many cases, a relatively dense or coarse concrete mixture is required for various applications. With this type of concrete, it is virtually impossible to use the existing ball valve in the pump. That is, the dense and/or coarse material tends to become congested in the ball valve. This effect causes the pump to become clogged and inoperative.

The present invention relates to an apparatus for sealing the joint between two or more reciprocating pump cylinder outlets with an inlet opening on a piece of pipe oscillating between said two cylinders and in particular to such joints for reciprocating slurry pumps.

In prior art concrete pumps a pivot pipe serves to alternatively communicate with the two cylinder openings on the slurry pump as per the invention, which forms the end of the pressure pipe that supplies the dispensing nozzle. The free end of the pivot pipe is moved by a hydraulic actuator between the two openings of the cylinders in the feed and suction stroke of its pistons so that the feeding cylinder presses the slurry into the inlet of the pivot pipe, while the opening of the other cylinder is cleared, which means it is in direct communication with the supplied slurry and sucks it in. The slurry (concrete) is fed under pressure into the pivot pipe and then flows immediately from this into the pressure pipeline that is in fluid communication with a dispensing nozzle.

On positive displacement concrete pumps the upstream face of the pivot pipe that oscillates from one cylinder to another cylinder must form a fluid tight seal. The upstream face of the pivot pipe in the prior art is typically provided with a wearing ring as illustrated in the prior art, see U.S. Pat. Nos. 4,178,142 and 6,338,615. The wearing rings are necessary to limit the amount of damage and wear due to impact and abrasion caused by the relative movement between the pivot pipe 1 and openings of two cylinders on the pump.

In concrete pumping applications owners must schedule the proper maintenance and replacement of pump and pipeline components prior to a component failure during use. This prevents unnecessary and costly loss of time due to system failures, as well as the inefficient waste of concrete which may become unusable as a result of the delays associated with the failure of a pump or pipeline component. At the same time, for economic reasons, it is desirable to schedule the maintenance and replacement of pump and pipeline components only when necessary and as infrequently as possible.

In the concrete pumping business, pump maintenance is typically scheduled based upon the number of cubic yards of concrete that have been pumped. The pump owner frequently estimates the cubic yardage of concrete pumped by referring to the concrete supplier delivery tickets. In the prior art the wearing rings on the front face of the pivot pipes typically need to be replaced due to wear whenever 40,000 cumulative cubic yards of concrete has been pumped. Because conventional slurry pumps are required to withstand abrasive conditions, it is necessary that they are constructed of alloys of high hardness, thus making machining of the parts expensive and difficult. To ensure correct alignment and sealing, it is necessary that the joint elements including the wearing rings of these pumps are machined to exact requirement. This, therefore, increases the cost in the production of such pumps including the valves incorporated therewith.

In an effort to improve performance and reduce the frequency of replacement of wearing rings in the prior art (see FIG. 8), tungsten carbide tiles 51 in the shape of segmented arcs have been brazed to the forward facing surface of the wearing ring housing 53 that contacts and seals the two cylinders of the pump. Such prior art efforts have been successful in extending the frequency of necessary maintenance from 40,000 to about 75,000–80,000 cubic yards of typical concrete.

These prior art wearing rings with tungsten carbide tiles brazed thereon however frequently suffer from drawbacks at a significantly lower volume than their estimated 80,000 cubic yards of concrete. The wearing rings with tungsten carbide tiles failed prematurely before warranty. The tiles 51 on the wearing rings did not fail on account of normal operational wear. The premature failure of the wearing rings occurred due to tungsten carbide tiles being knocked off the wearing ring housing 53. The tungsten carbide tiles in the prior art illustrated in FIG. 8 where often knocked loose after the braze bonding the tiles to the wearing ring housing became weakened by the wash out of both the braze and softer material of the housing. The braze and/or softer material of the housing 53 in such prior art was washed out by the abrasiveness of the concrete flow at a much quicker rate than the tungsten carbide wore out. Prior art efforts also attempted to reduce the rate of wash out of the housing 53 by hardfacing the inner bore 55. The hardfacing assisted in slowing down tiles from being washed out, but due to the violent nature of the flow of concrete, its success was not satisfactory because it wore much quicker than the tiles, resulting in tiles having significant useful wear life still remaining being washed out prematurely. In addition to the tiles being udercut by wear at 55, material flow would penetrate the cracks 57 between adjacent tiles 51, loosening the braze thereunder and causing softer housing material to washout beneath tiles.

After one tile became knocked off, the tile adjacent the absent tile became more disposed to becoming washed out, compounding the premature failure of the wearing rings. The premature failure in prior art concrete pumps/rings would cause costly unscheduled maintenance as discussed above.

As the braze washed out at the joints between adjacent tiles on the front sealing surface of the wearing ring, concrete would leak out at those points creating pressure head losses lowering the efficiency of the pump. Whenever a first tile is knocked loose significant losses in pressure occur with the pump quickly becoming inoperable as additional tiles become knocked off. In addition, as a tile becomes displaced, the softer material behind the tile is directly exposed to material flow. The softer material wears at an accelerated rate. In the event that a tile is knocked off, if an operator fails to recognize this situation, the pivot pipe and components other than the wearing rings can quickly become damaged by the high speed oscillating pivot pipe.

There is a need in the industry for a wearing ring on a pivot pipe or similar apparatus with improved performance in durability against abrasive wear caused by concrete material flow or other abrasive materials.

SUMMARY OF THE INVENTION

It is an object of this invention to construct wearing rings with improved durability and extended life that are not required to be changed frequently and less likely to fail prematurely due to wash out.

The container wearing rings and pivot pipe wearing ring each include a sealing surface and flow bore portion. Each of the container wearing rings and pivot pipe wearing rings are constructed from two pieces, an inner ring and a holding ring. The inner ring forms the sealing surface and a section of the flow bore. All of the inner rings are constructed from a hard material into a monolithic piece.

The monolithic inner rings are made from cemented tungsten carbide. The inner rings are molded and pressed into shape requiring no additional machining reducing costs and expenses.

These and other objects and advantages will become evident from the description which follows.

DESCRIPTION OF THE PREFERRED EMBODIMENT

The present invention has many applications in many different environments and relates to a fluid wear ring for oscillating pivot pipes. In the following descriptions, the fluid wearing is described for use with a thick-material sludge pump. In the following description, the thick-material sludge described is concrete. Concrete pumps having a pivot pipe are well known in the industry. U.S. Pat. Nos. 6,338,615 and 5,106,272 show and describe pivot pipes for concrete pumps. U.S. Pat. Nos. 6,338,615 and 5,106,272 are hereby incorporated by reference in their entirety.

Figure 1:
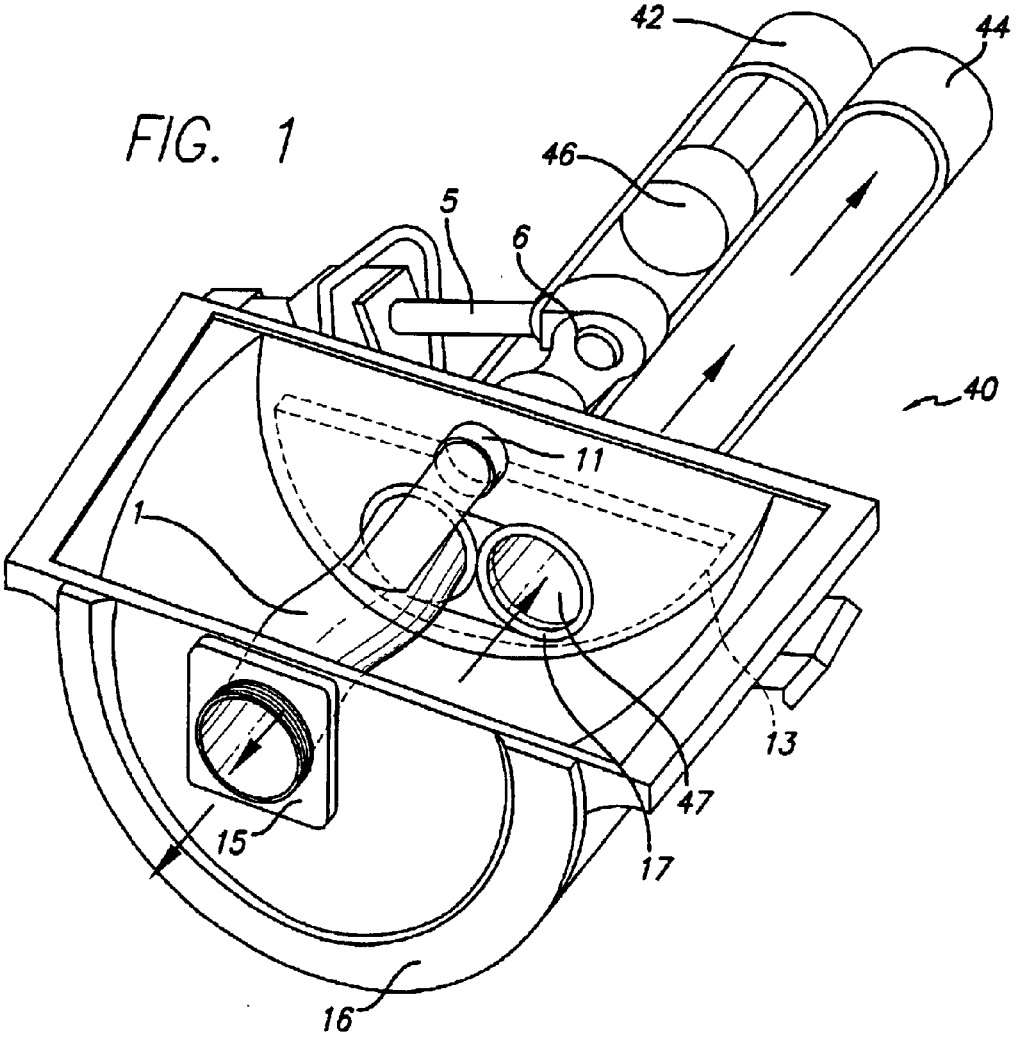
FIG. 1 is a perspective view of a double cylinder pump for conveying cement other type of sludge.

FIG. 1 shows a material supply container 10 in communication with a two-cylinder positive displacement material pump 40. Pump 40 includes material cylinders 42 and 44, material pistons 46, and a second piston in the other cylinder 44 (not shown).

Concrete or other material is supplied to material supply container 10, in which a pivot pipe 1 is positioned. Pivot pipe is connected at its upstream inlet with an opening 47 of one of the two material cylinders 42,44 (in the FIG. 1 position, the inlet is connected to cylinder 42), while the opening 47 to the other material cylinder (in this case, cylinder 44) is opened to the interior of material supply container 10. The sequence of operations of pump 40 is generally as follows. As a piston reciprocates in one of the material cylinders (in FIG. 1, cylinder 42), it discharges material into the pivot pipe 1, while the other cylinder 44 is loading material through its opening 47 from material supply container 10. At the end of the pumping stroke, material piston 46 is at its closest point to the pivot pipe, while the other piston is at a position furthest from pivot pipe. At this point, transducers that are well known in the art sense that hydraulic drive piston 46 has reached the forward end of its stroke. Hydraulic actuator 5 is activated to cause pivot pipe 1 to swing so that upstream inlet to the pivot pipe 1 is now connected to cylinder 44 instead of cylinder 42. The operation continues with one material piston 44 or 42 operating in a filling stroke, while the other is operating in a pumping or discharge stroke.

The container 10 has an outlet coupling 15 for connection to a pipeline 14 that supplies concrete/sludge to a downstream dispensing nozzle (not shown) for discharging concrete onto a work site in the field.

Figure 2:
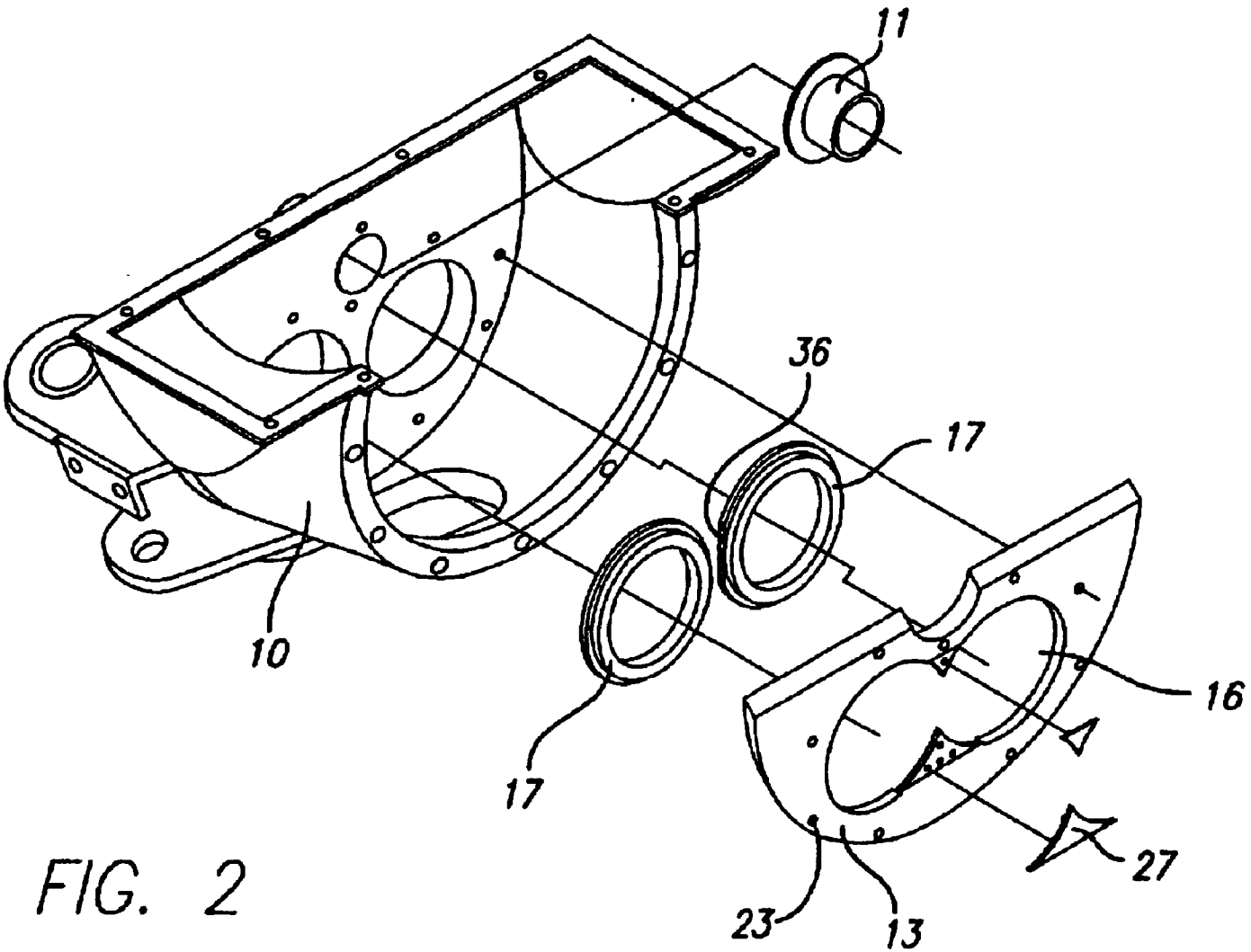
FIG. 2 is an exploded view of the pump supply container.
Figure 4:
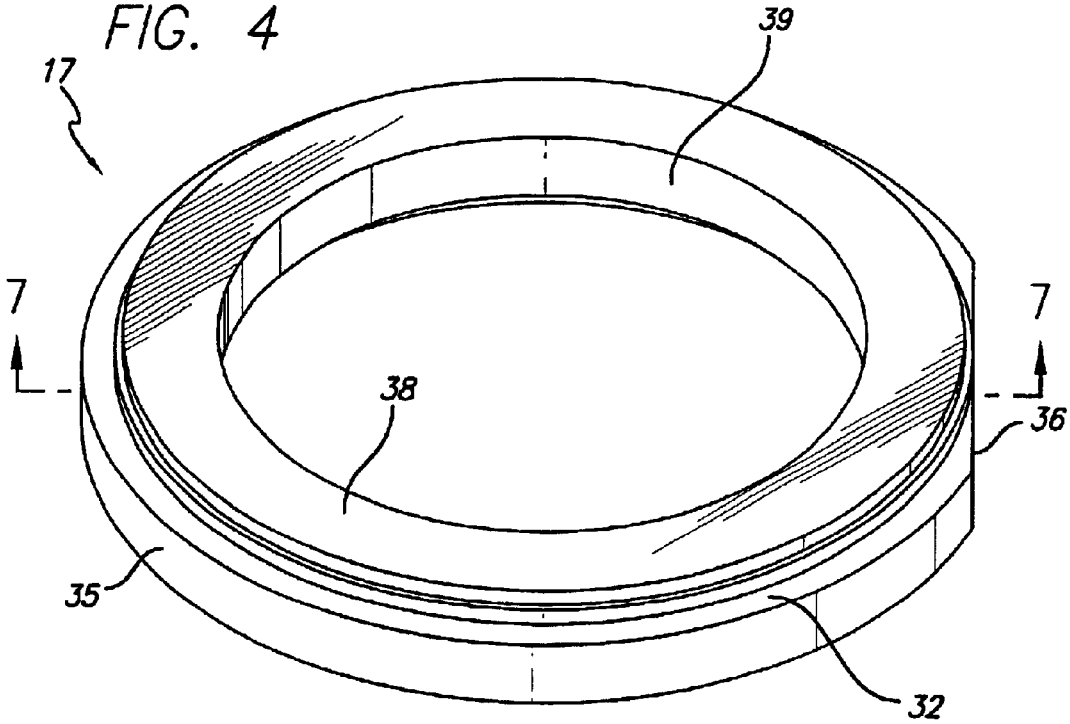
FIG. 4 is a perspective view of one of the pump container wearing rings.
Figure 7:
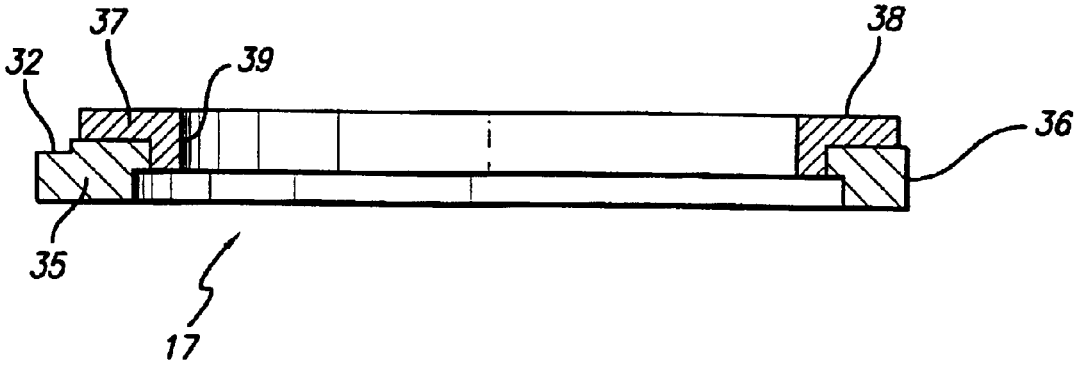
FIG. 7 is a cross sectional view of the pivot pipe wearing ring shown in FIG. 4.

FIG. 2 shows an exploded view of the invention. The supply container wearing rings of the invention are identified by number 17. The supply container wearing rings 17, as shown in FIGS. 4 and 7, are constructed from an outer holding ring 35 and an inner flow ring 37. The inner flow ring 37 is mounted to the outer holding ring 35 by epoxy. The inner flow ring 37 is made from a hard abrasion resistant material such as cemented carbide. The inner flow ring 37 in an embodiment of this invention is a solid monolithic WC—Co piece made from a high quality grade of cobalt tungsten carbide. The upstream end of the pivot pipe is in contact with the interior face of the supply container 10 as the pivot pipe 1 oscillates between cylinders 42/44. The upstream end of pivot pipe 1 as it oscillates from one cylinder 42/44 to the other 42/44 contacts the container sealing surface 38 of the wearing rings 17. The pivot pipe 1 during oscillation contacts the container sealing surfaces 38 mounted inside the supply container 10. The incorporation of monolithic hard material rings 37 eliminates the inherent weakness of the prior art wherein a plurality of arcuate tiles, sometimes as many as 12 arcuate tiles, were brazed together to form the sealing surface of wearing rings. The present invention's monolithic inner flow rings 37, it is contemplated, can be made from a cemented WC—Co.

Figure 8:
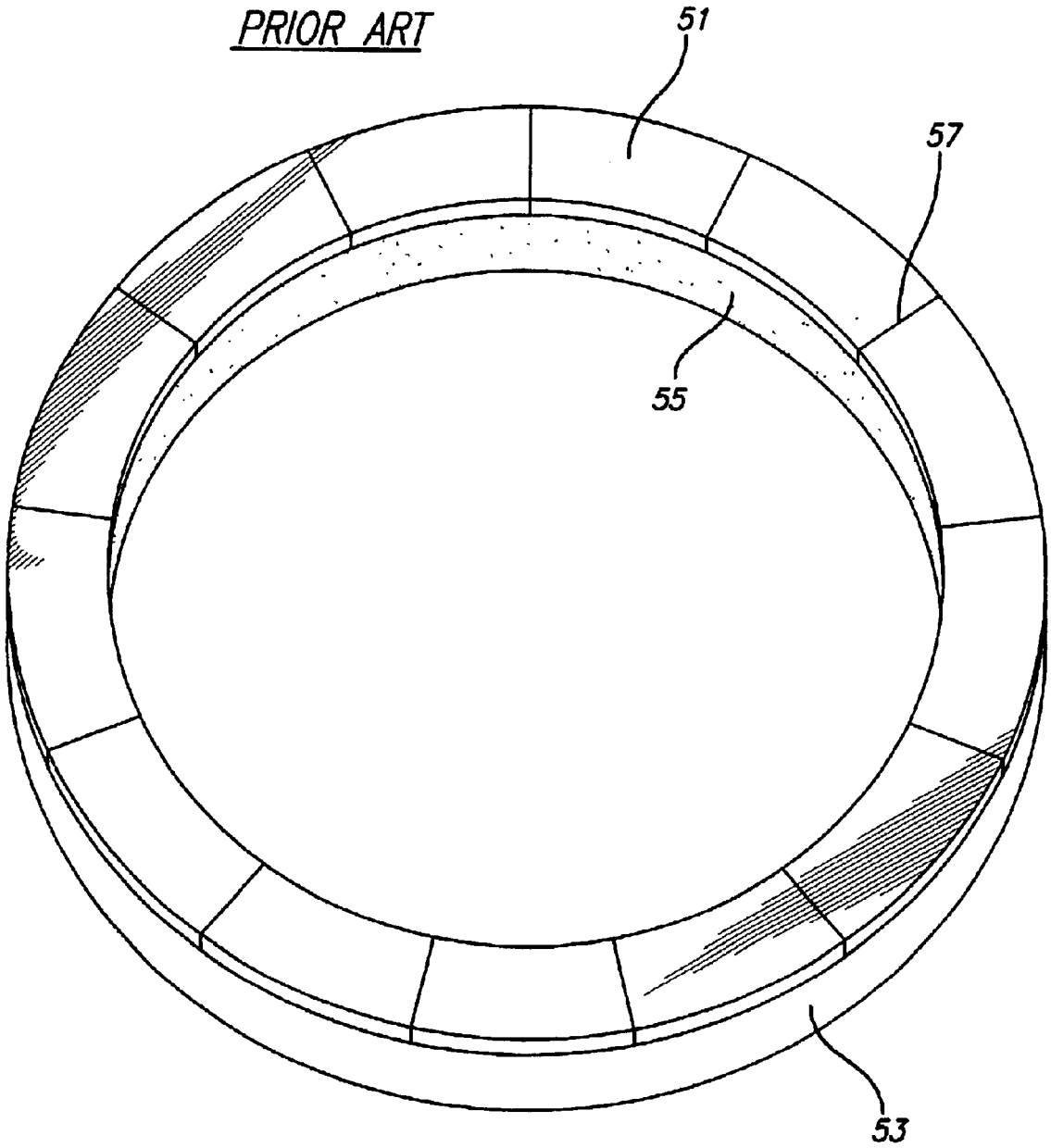
FIG. 8 PRIOR ART
FIG. 8 illustrates a wearing ring employed in the prior art.

The rings are designed to be received in the opening 16 formed in the plate 13. The opening 16 is generally FIG. 8 shaped. The two container wearing rings 17 have a stepped exterior including an annular flanges 32 at one end that mates to tightly fit within a cooperating recess around the circumference of the opening 16 in plate 13 (forming two adjacent female sockets). The wearing rings 17 are tightly positioned together within opening 16. The plate is next attached to the supply container 10 with a plurality of bolts inserted into openings 23. The bolts securely fasten the plate 13 and wearing rings 17 against an internal wall of the material supply container 10.

As best seen in FIG. 4, a flat notch 36 is formed on one section of the annular flange 32. Both container wearing rings 17 include a notch section 36. The notches 36 formed on the rings 17 are identical in shape and size and are placed in cooperative contact with each other upon assembly into the plate 13, as best seen in FIG. 2. The notches 36 contact each other along an imaginary line that bisects the opening 16 in the plate 13.

Figure 3:
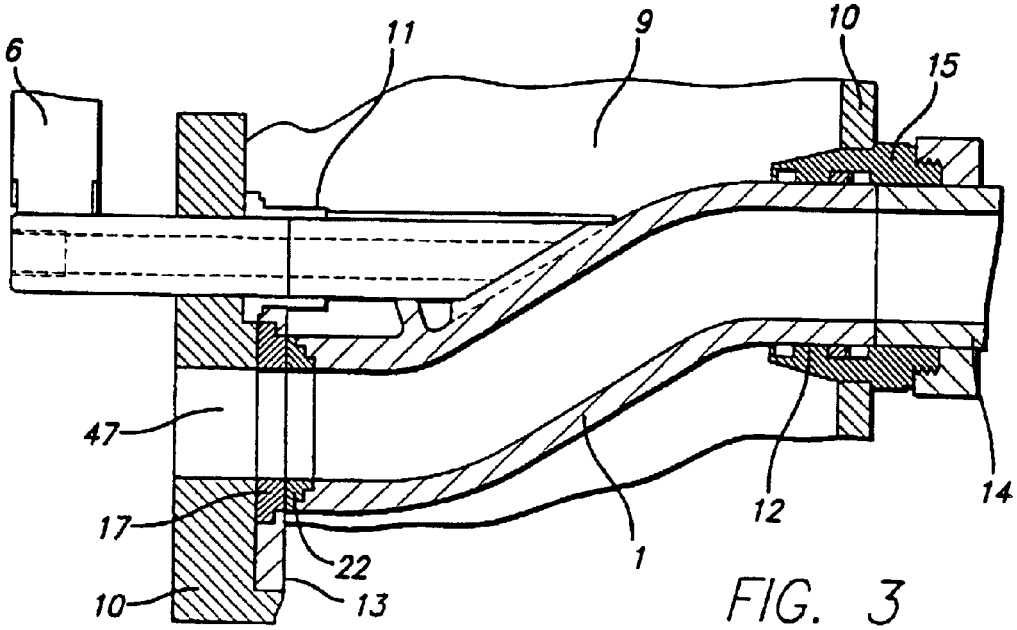
FIG. 3 is a partial cross sectional view of the supply container.
Figure 5:
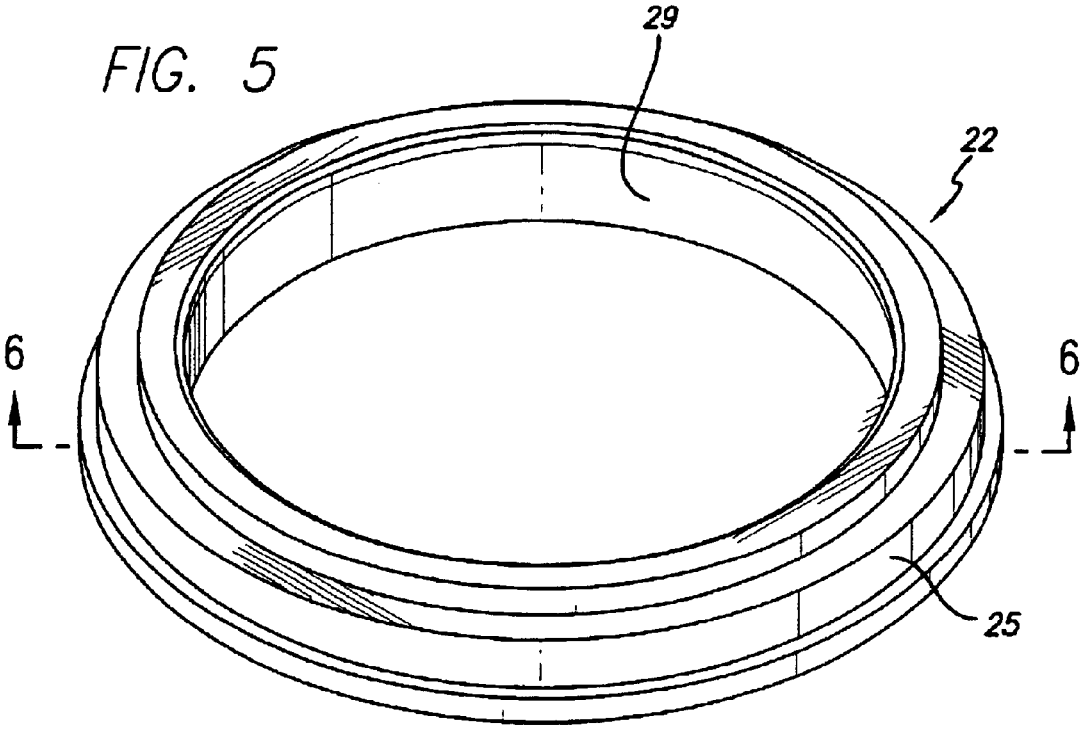
FIG. 5 is a perspective view of a pivot pipe wearing ring.
Figure 6:
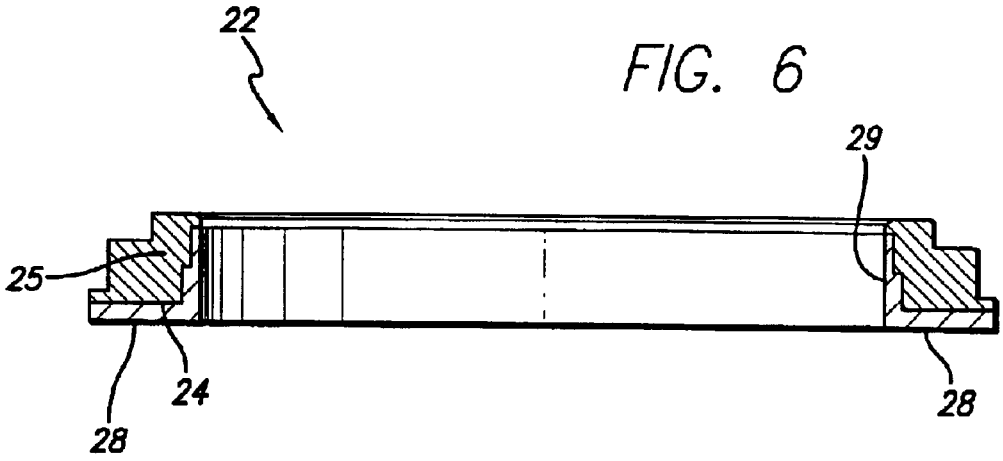
FIG. 6 is a cross sectional view of the pivot pipe wearing ring shown in FIG. 5.

The pivot pipe 1, as shown in FIG. 3, includes a wearing ring 22 that is inserted within a mating female socket on the upstream end of the pivot pipe 1. The wearing ring 22 is tightly positioned within the pivot pipe. The pivot pipe 1 wearing ring 22, as shown in FIGS. 5 and 6, similar to the container wearing rings 17, is constructed from an outer holding ring 25 and an inner flow ring 24. The outer holding ring 25 and inner flow ring 24 in FIGS. 6 and 7 are designed to be snugly joined together along cooperating mating steps. The inner flow ring 24 may be fixed to the outer holding ring 25 by applying an epoxy along the adjoining surfaces of the holding ring 25 and inner flow ring 24. The inner flow ring 24 is made from a hard abrasion resistant material such as cemented carbide. The wearing ring 22 on the upstream end of the pivot pipe 1 abuts against the wearing rings 17 on the supply container 10. The pivot pipe is designed to be held against the supply container to form a liquid tight seal. The pipe wearing ring 22 can be biased against the wearing ring 17 by elastic rings placed between the wearing ring 22 and upstream end of the pivot pipe. Prior art methods of biasing the wearing rings are disclosed in U.S. Pat. Nos. 6,338,615 and 5,037,275, which are hereby incorporated by reference in their entirety. It is contemplated that for other embodiments, other well-known means in the industry for forming a liquid tight seal may alternatively be employed, including but not limited to brazing.

Because the sealing surfaces of pipe wearing ring 22 and container wearing rings 17 are biased into contact, a resultant friction force arises therebetween. The friction forces between the sealing surfaces 28,38 independently cause wear as the pivot pipe 1 oscillates back and forth between the two cylinders 42,44. Fine solid particles of gravel or lime in the concrete during pumping are caught between the sealing surfaces 28,38 functioning like sand paper, substantially increasing the wear rate of the sealing surfaces 28,38. Further, it should be noted that as the pivot pipe oscillates back and forth between the openings 47 of the cylinders 42,44 all the sealing surfaces 28,38 are subjected to increased wear caused by the impact of concrete gravel (or other solid material) that arises due to the movement of the pivot pipe. Additionally in the prior art, wash out of tiles 51 was caused by increased impact wear and abrasive wear occurred on the wearing rings along the sections that formed the axial interior bore (see interior bore 55 in FIG. 8). The increased wear at 55 (FIG. 8) was attributable to the additional flow turbulence near the openings and larger gravel pieces being caught and sheared between the high speed (20–30cycles/minute) oscillating pump and cylinders. As the larger pieces of gravel are sheared, they violently impact against the respective interior bores of the pivot pipe and cylinders immediately adjacent their openings. In the present invention, the hard material inner flow ring 24 for the pivot pipe has a rearwardly extending section having a central axis that forms a flow bore portion 29 of a sufficient distance to limit the increased wear that occurred at this location in the prior art. Similarly, the hard material inner flow ring 37 for the container has a rearwardly extending section that forms a flow bore portion 39 of sufficient distance along the material flow path to protect this area that is much more susceptible to wear.

The inner flow ring 24 and its pipe sealing surface 28 as discussed above is constructed of cemented tungsten carbide for enhancing resistance to wear of the sealing surface caused by the oscillating pivot pipe. The pipe sealing surface 28 cooperates with sealing surfaces 38 mounted on the container 10. The monolithic design of the container sealing surfaces 38 and pivot pipe sealing surface 28 form an improved seal that is not susceptible to the premature failures of the prior art.

The container wearing rings 17 and pipe wearing rings 22 may be manufactured by combining a powder such as tungsten carbide with a binder such as cobalt, nickel, manganese, chromium and their alloys or other similar chemical compositions. The powder and binder may be blended and compacted in a press or similar device. The resulting wearing rings, provided by pressing the powder and binder, may be sintered in a vacuum, at temperatures from about 1300 degrees Centigrade to 1500 degrees Centigrade, in an inert atmosphere composed typically of nitrogen and argon and other well-know gases in the industry. In some embodiments, it is contemplated that a cemented tungsten carbide having a weight percentage of cobalt binder that falls within the range of 5%–15%. In one contemplated embodiment, the container wearing rings 17 and pivot pipe wearing ring 22 are each made from a cemented tungsten carbide having a composition of approximately 12% Cobalt with a measured hardness value HRa of about 90.1. Wearing rings made from powders having a size of 2–6 microns and a percent weight of Cobalt of 12%–14%, a magnetic saturation average 92%, a grain gap HC 110–150 with a Rockwell Hardness value HRa 87.0–88.9 and a TRS value of approximately 475,000 have been shown to be very effective in resisting wear. It is contemplated that the wearing ring cemented carbide composition of 89% WC and 11% Cobalt, a density of 14.30–14.50 grams/cubic cm and a Rockwell Hardness (HRa) of between 88.0–89.0 have demonstrated an ability to reduce the wear rate. For some applications, the wearing rings can be made of a highly wear resistant cemented tungsten carbide, as disclosed in U.S. Pat. No. 4,859,593, to Greenfield et al. U.S. Pat. No. 4,859,593, to Greenfield et al., is hereby incorporated into the specification in its entirety.

While a particular embodiment of the invention has been illustrated and described, it will be obvious to those skilled in the art that various changes and modifications may be made, and other embodiments utilized, without departing from the scope of this patent. It is intended that the following claims cover all such modifications and embodiments, and all other modifications and embodiments, and all equivalents of such modifications and embodiments, that fall within the spirit of this invention.

What is claimed is:

1. A wearing ring for a pump, comprising:

an inner flow ring and a holding ring, wherein said inner flow ring is monolithic and forms a sealing surface and a flow bore portion for providing wear resistance against abrasion and impact of material flow, wherein said flow bore portion has a central axis and said sealing surface is perpendicular to said axis, wherein said holding ring has an annular flange for mounting said wearing ring onto a material supply container plate having a cooperating annular recess, and wherein said holding ring has a notch section for mounting said wearing ring in cooperative contact with another wearing ring.

2. The ring according to claim 1, wherein said inner flow ring is constructed from cobalt cemented tungsten carbide having between 5%–15% Cobalt binder.

3. A two-cylinder pump for pumping a thick material sludge comprising:

a pivot pipe, where the pivot pipe is pivotal in front of a plate disposed between an upstream end of said pivot pipe and two pump cylinders, and container wearing rings are positioned within an opening in said plate, wherein said container wearing rings include a flat notch.

4. The two-cylinder pump according to claim 3, wherein the container wearing rings each include an inner flow ring and a holding ring, wherein said inner flow ring forms a monolithic sealing surface.

5. The two-cylinder pump according to claim 4, wherein said inner flow ring is constructed from a hard material resistant to wear.

6. The two-cylinder pump according to claim 5, wherein said hard material is a cemented carbide.

7. The two-cylinder pump according to claim 6, wherein said cemented carbide is tungsten carbide having between 5%–15% Cobalt binder.

8. The two-cylinder pump according to claim 4, wherein said inner flow ring includes a flow bore portion for providing wear resistance against abrasion and impact of material flow.

9. A wearing ring for a pump comprising:

an inner flow ring and a holding ring, wherein said inner flow ring is monolithic and forms a sealing surface and a flow bore portion for providing wear resistance against abrasion and impact of material flow, wherein said holding ring has an annular flange for mounting said wear ring onto a material supply container plate having a cooperating annular recess, and wherein said holding ring has a notch section for mounting said wearing ring in cooperative contact with another wearing ring.

10. The ring for a pump according to claim 9, wherein said inner flow ring is constructed from a hard material resistant to wear.

11. The ring for a pump according to claim 10, wherein said hard material is a cemented carbide.

12. The ring for a pump according to claim 11, wherein said cemented carbide is tungsten carbide having between 5%–5% Cobalt binder.

13. The ring for a pump according to claim 9, wherein said inner flow ring has a stepped exterior surface.

14. A two-cylinder pump for pumping a thick material sludge comprising:

a pivot pipe, where the pivot pipe is pivotal in front of a plate disposed between an upstream end of said pivot pipe and two pump cylinders, said pivot pipe having a pivot pipe wearing ring, and container wearing rings or positioned within an opening in said plate, wherein each of said container wearing rings has an annular flange.

15. The two-cylinder pump according to claim 14, wherein said pivot pipe wearing ring and said container wearing rings each include an inner flow ring and a holding ring, wherein said inner flow ring is constructed from a hard material resistant to wear.

16. The two-cylinder pump according to claim 15, wherein said hard material is a cemented carbide.

17. The two-cylinder pump according to claim 16, wherein said cemented carbide is tungsten carbide having between 5%–15% Cobalt binder.

18. The two-cylinder pump according to claim 15, wherein each said inner flow ring include a flow bore portion for providing wear resistance against abrasion and impact of material flow.

* * * * *